United States Patent [19]

Brusa

[11] 4,082,254

[45] Apr. 4, 1978

[54] HEAT EXCHANGER AND APPLICATION THEREOF TO REALIZE AN ORE REDUCING FURNACE

[76] Inventor: Ugo Brusa, Via Borgnis, Domodossola, Italy

[21] Appl. No.: 716,236

[22] Filed: Aug. 20, 1976

[51] Int. Cl.[2] ..... C21B 1/12

[52] U.S. Cl. ..... 266/175; 266/177

[58] Field of Search ..... 266/175, 177

[56] References Cited

U.S. PATENT DOCUMENTS

| | | | |
|---|---|---|---|
| 849,465 | 4/1907 | Dings | 266/177 |
| 1,113,962 | 10/1914 | Dern et al. | 266/177 |
| 2,039,833 | 5/1936 | Payne | 266/175 |
| 2,085,625 | 6/1937 | Anderson | 266/177 |
| 3,512,766 | 5/1970 | Oberndorfer | 266/175 |

FOREIGN PATENT DOCUMENTS

| | | | |
|---|---|---|---|
| 2,851 of | 1882 | United Kingdom | 266/177 |

*Primary Examiner*—Gerald A. Dost

[57] ABSTRACT

The invention concerns an apparatus for heat exchange between a hot and a cold body in particular in form of fluids, divided by a partition wall, in which apparatus a portion of the wall, contacting the hot fluid, is moved and is brought in place of a corresponding wall portion contacting the cold fluid. The invention concerns also the application of the apparatus in a chamber for ore reduction.

5 Claims, 11 Drawing Figures

FIG. 1
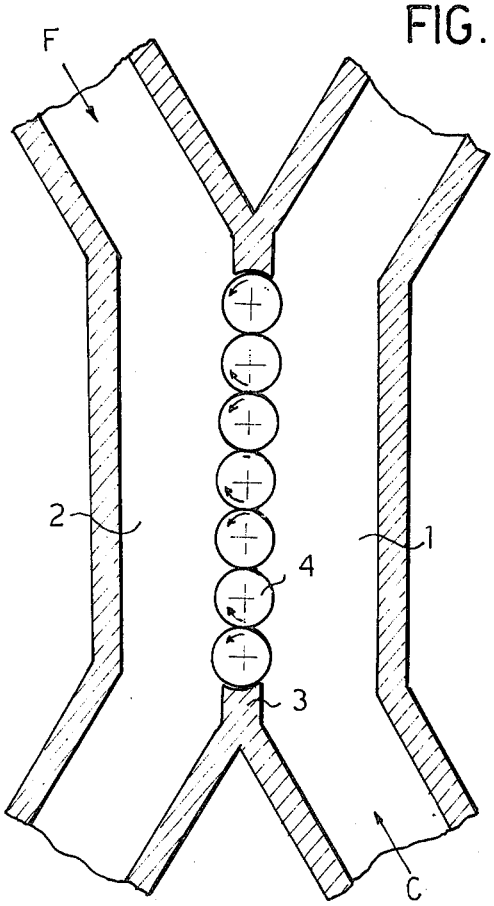
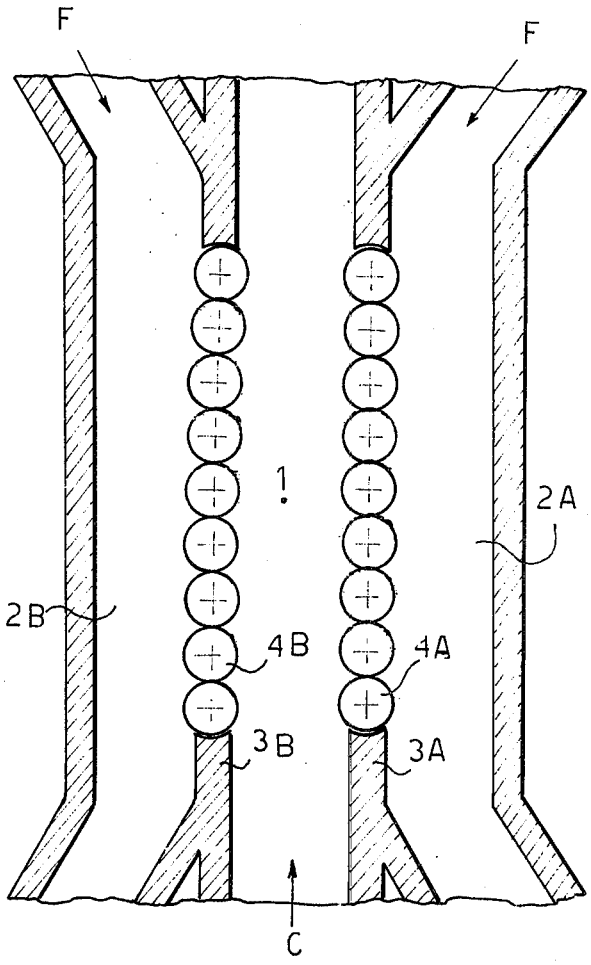
FIG. 2

FIG. 4
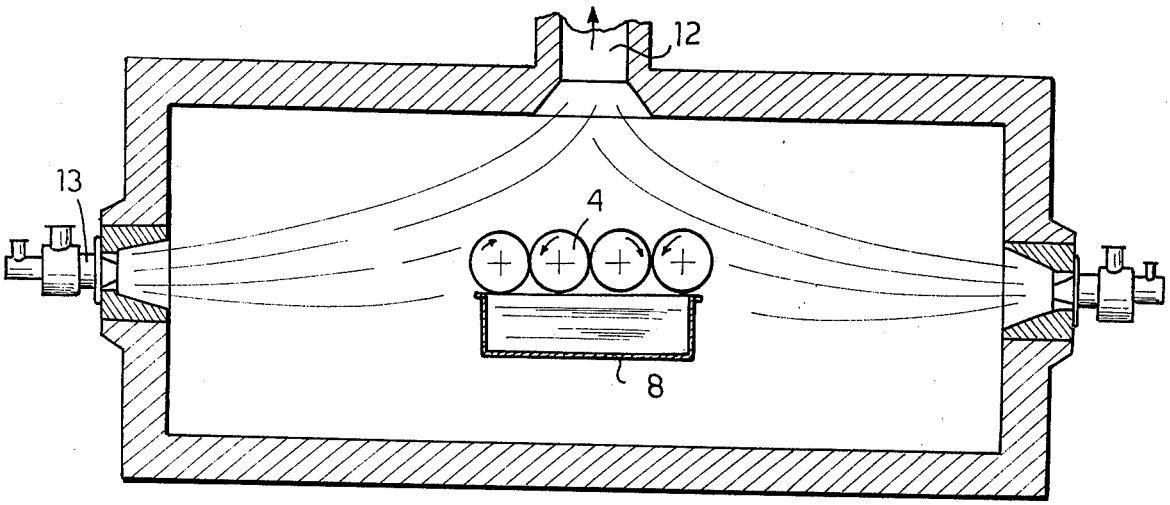
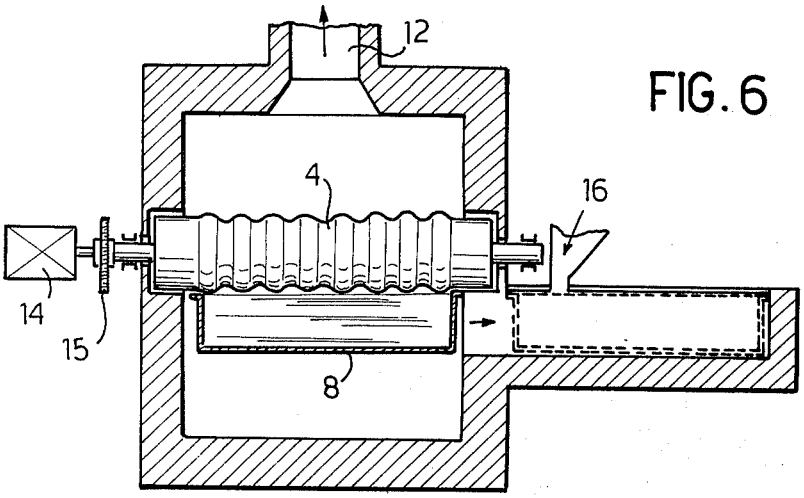
FIG. 6

HEAT EXCHANGER AND APPLICATION THEREOF TO REALIZE AN ORE REDUCING FURNACE

The present invention relates to a heat exchanger and to a preferred application thereof in the field of ore reduction.

The heat exchangers more commonly used to transfer heat from a first to a second fluid (which fluids can be stationary or moving) comprise a fixed wall separating the two fluids, the heat passing from one fluid to the other through the wall.

In these conditions, in order for the heat transmission occur, a considerable temperature difference between the two faces of the wall is required, and consequently the transmission coefficient is rather low.

The invention is based upon the consideration that better conditions may be achieved by moving at least part of the hotter surface of said wall, that is the surface which has received the heat directly from the hot fluid, so that such a part replaces a corresponding part in the colder surface of said wall, that is the surface which has to transmit heat to the fluid to be heated.

Being eliminated in this way the need for a drop in the temperature from one wall surface to the other, the efficiency of the heat transmission, which occurs simultaneously by convection and radiation, is much higher.

Generally speaking, the invention consists in moving at least a part of the wall in contact with the hot fluid and bringing said part into contact with the cold fluid.

As a practical realization, a first way of operating is to provide the wall dividing the two fluids with a set of rollers, with parallel axes, substantially tangent to each other and able to rotate about their own axes.

In this way at each instant the half of the cylindrical wall surface facing the hot fluid is heated, whereas in the subsequent half turn said wall, facing the fluid to be heated, yields heat in a more efficient way as if the rollers were stationary and the heat had to pass through the rollers, from one face to the other thereof.

In practice said rollers may also have on their longitudinal surface a plurality of variously shaped grooves or projections.

Another way of carrying out the invention is to provide the surface separating the hot body from the body to be heated with a set of holes, preferably of cylindrical shape, within which a set of pistons is caused to reciprocate so that a part of their outer surface alternately contacts the hot body and the body to be heated.

Still another way of realizing the invention is to provide said separating wall with an opening in which a round body, consisting of a deeply grooved cylinder, may rotate within a small clearance.

As to the preferred application, that is ore reduction, the apparatus according to the invention comprises a chamber housing a basin which contains the ore in small pieces to be reduced, and above this ore a set of rollers in contact with one another is arranged; the chamber is heated by burners which bring the temperature of the rollers to a high value, and in turn said rollers, due to their rotation, direct towards the contents of the basin the face which at that moment is hotter. A very good heat transmission, especially by radiation is thus obtained, and moreover the gases evalving from the basin, which is maintained in a reducing atmosphere, pass into the part of the chamber containing the burners and burn in turn, thereby allowing a considerable heat recovery.

According to another embodiment of the invention the projections of a rotating, grooved disc are dipped in the basin containing the substance to be reduced.

According to yet another embodiment, reciprocating pistons are partly dipped into the basin.

According to a further embodiment of the invention, the basin has the shape of an annulus with vertical axis and is connected to a motor which causes the rotation thereof about the axis, receives the charge continuously from a hopper and brings said charge through a great portion of a turn under a plurality of conical rollers with longitudinal horizontal axis, substantially in contact with one another, rotated by a set of motors and heated in their upper portion by burners.

In this case the last portion of the annular rotation, in which neither rollers nor burners are provided, is subjected to the action of a group of electrodes causing the melting of the mixture, which then is laterally or radially withdrawn in liquid condition, thereby leaving again free the basin-shaped platform, which may receive another charge.

These and other features of the present invention will clearly result from the following description, with reference to the accompanying drawings, in which:

FIG. 1 is a diagrammatic vertical cross-section of a first embodiment of a heat exchanger according to the invention;

FIG. 2 is a view similar to the preceding one and shows the embodiment of a double movable wall;

FIGS. 4, 5 and 6 are a longitudinal cross sectional view, a plan view and a side view, respectively, of a reducing chamber similar to the preceding one;

Figure 3:
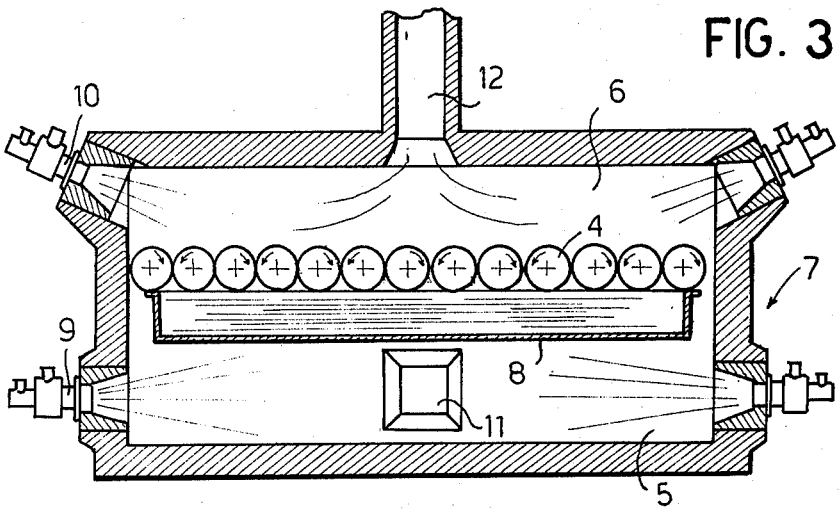
FIG. 3 is a vertical cross-section through an ore reducing chamber according to the invention.

Referring to the drawings, FIG. 1 shows a heat exchanger able to operate as a chimney with recovery of the exhaust heat.

It comprises two channels 1, 2 for the passage in countercurrent of the hot gas (for instance fumes) and of the cold gas (for instance air); the two channels are arranged side by side over a part of their length and in this part they are separated by a wall 3 having an opening rendered substantially gas-tight, by a row of rollers 4 with parallel axes, substantially in contact with one another, and provided with means (not shown) which cause the rotation thereof about the axes.

Preferably, adjacent rollers rotate in opposite directions in order to reduce the mutual friction.

The operation of the described exchanger is self evident: the hot gas, entering through C, heats the face of rollers 4 facing channel 1, which face, due to the rotation, in a subsequent instant is directed towards channel 2 and yields heat, by contact and radiation, to the cold fluid entering through F.

The construction and the operation of the exchanger of FIG. 2 are quite similar: here the channel 1 for the hot fluid has at its sides two channels 2A, 2B, with partition walls 3A, 3B and two set of rollers 4A, 4B.

According to FIG. 3, the set of rollers 4 does not separate two different channels, but the lower portion 5 and the upper portion 6 of a chamber 7 forming an ore reducing furnace.

The ore is contained in a basin 8, upwardly open and arranged under the group of rollers 4.

The two parts of the chamber are provided with burners 9 and respectively 10; moreover the lower part 15 has an opening 11 allowing to introduce a reducing atmosphere, and the upper portion has a chimney 12 for the exhaust of the gases.

The operation of this furnace is self evident from the drawing and from the preceding description; it is still to be appreciated that the gases evolving from the ore during the reduction, as well as the reducing gases passing past the group of rollers 4, burn in chamber 6 and aid in improving the thermal balance, by heating the rollers 4 which in turn heat basin 8.

Figure 5:
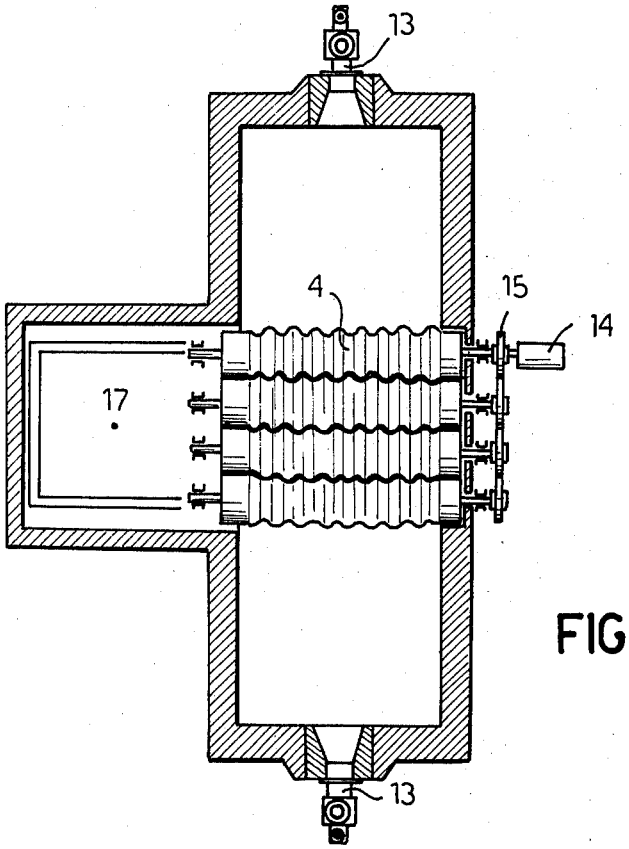

The embodiment shown in FIGS. 4, 5, 6 is similar: these figures show also motor 14 which through gears 15, rotates rollers 4. It is clearly apparent that these rollers are deeply grooved. Also the hopper 16 for delivering the mixture, and the niche 17 to which basin 8 can be moved for the loading operations, are shown.

Figure 7:
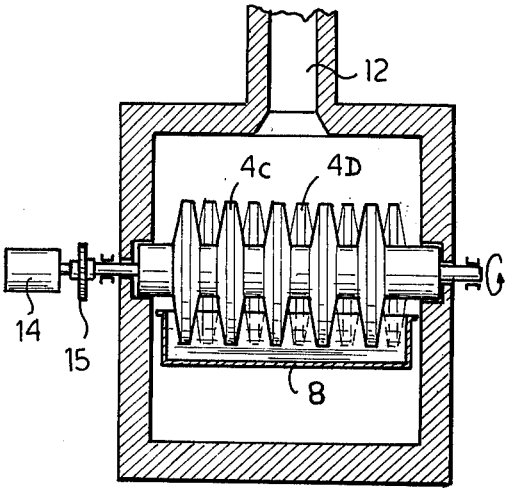
FIGS. 7 and 8 show two modified embodiments of the chamber of FIGS. 4 to 6.

In FIG. 7 rollers 4C, 4D are provided with disc shaped projections which are partly dipped into the mixture to be treated and heat said mixture by contact and radiation.

Figure 8:
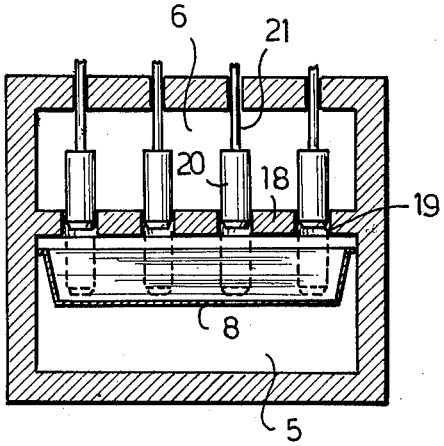

FIG. 8 shows the two portions 5 and 6 of the reduction chamber separated by a horizontal partition 18 provided with holes 19 in which pistons 20 can slide. The pistons have rods 21 protruding from the chamber roof for connection to actuating members (not shown).

The reciprocation of pistons 20 causes them to be alternately in contact with the atmosphere of the heated chamber 6 and of the mixture contained in basin 8.

Figure 11:
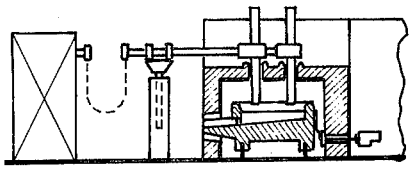
FIGS. 10 and 11 are two radial cross-sections of the same furnace.
Figure 10:
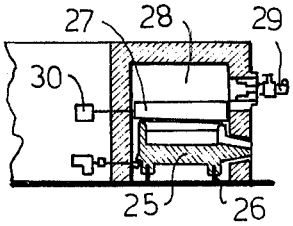
Figure 9:
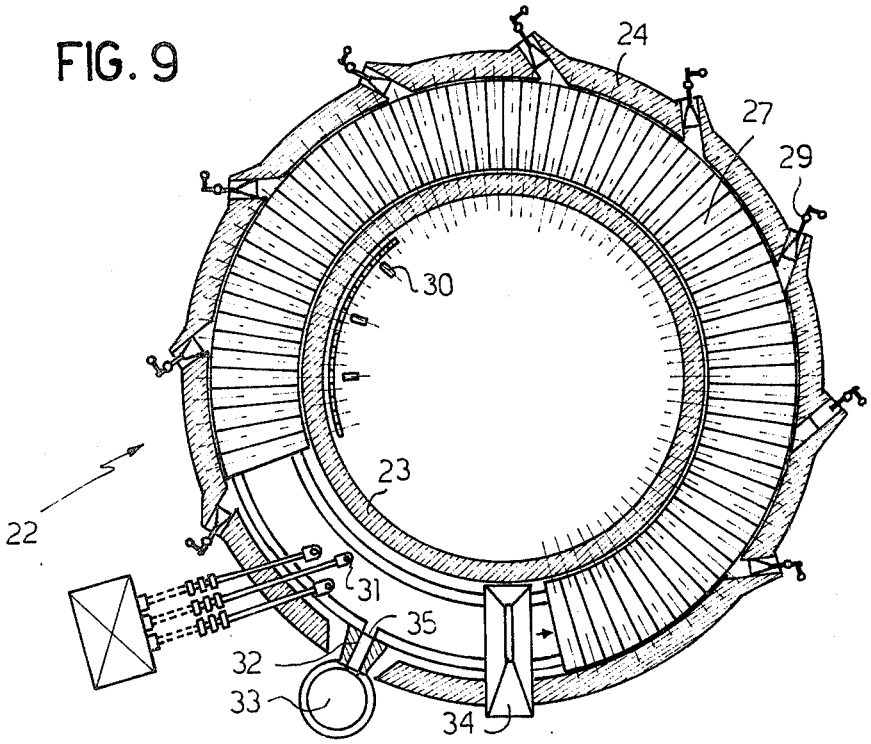
FIG. 9 is a plan view of a annular rotary furnace embodying the invention.

FIGS. 9, 10 and 11 show the rotary furnace, generally indicated at 22, which comprises cylindrical inner and outer masonries 23 and respectively 24 between which a rotating platform 25, provided with wheels 26, is arranged. Rollers 27 with horizontal longitudinal axes, substantially tangent to one another and driven by motors 30 are arranged above platform 25: the whole set of said rollers acts as a curtain separating the section in which there is the platform from the upper chamber 28 provided with burners 29.

This roller curtain extends substantially over $\frac{3}{4}$ of a turn and is missing in the remaining part of the turn where the electrodes 31, the casting opening 32 with ladle 33 and the loading hopper 34 for the mixture are arranged.

It will be appreciated that the platform or basin 25 has on its outer wall a number of normally closed holes 35, which are opened when they become radially aligned with opening 32.

The system for heating the mixture by means of burners 29 and rollers 27 is quite similar to that disclosed in connection with the previous embodiments.

Only few embodiments have been disclosed in order to show on one hand the construction of an exchanger according to the invention and on the other hand the utilization of the exchanger in a furnace for ore reduction; however several changes and modifications are possible without departing from the scope of the invention.

Although the heat exchange between two gases has been described in greater detail, the invention may be applied also to heat exchange between solid, liquid or gaseous bodies, in various combinations.

I claim:

1. Apparatus for reduction of ores, comprising:

(a) an annular chamber having an upper portion and a lower portion;

(b) moving means in said lower portion for supporting said ore;

(c) means for rotating said ore-supporting means along the annular path of said chamber;

(d) means for introducing heat into said upper portion of said chamber for heating said ore;

(e) means for separating said upper portion from said lower portion and consisting of at least one member having an outer surface which is alternately brought into contact with said upper and lower portions of said chamber, said separating means being provided in less than the entire annular area of said chamber;

(f) means for reducing said ore, located in the non-separated region of said annular chamber;

(g) means for introducing said ore to be reduced, located in the non-separated region of said annular chamber; and (h) means for discharging the reduced ore radially from said annular chamber and located in the non-separated region of said chamber.

2. The apparatus according to claim 1, wherein said separating means is a plurality of horizontally positioned rollers rotating tangentially to one another along their longitudinal axes, said rollers being provided with external means for effecting said rotation.

3. The apparatus according to claim 1, wherein said ore-supporting means is an upwardly open, annularly shaped basin having a radially-disposed trough therein for discharging said reduced ore when coming into alignment with said discharging means during its rotation along said annular path of said chamber.

4. The apparatus according to claim 1, wherein said separating means is a horizontally disposed divider having at least one opening therethrough and a piston-like member moving perpendicularly to the plane of said divider and through said opening, a portion of the outer surface of said piston-like member alternately coming into contact with the heated atmosphere of the upper portion of said chamber and with the ore in the lower portion of said chamber.

5. The apparatus according to claim 2, wherein said rollers are provided with a plurality of radial discs along their longitudinal axes, said discs rotatingly dipping into said ore in said lower portion of said chamber.

* * * * *